United States Patent [19]

Moscovich

[11] Patent Number: 4,479,654

[45] Date of Patent: Oct. 30, 1984

[54] GAME WITH CONVEYOR

[76] Inventor: Ivan Moscovich, 19 Elkachi St., Afeka, Ramat Aviv, Israel

[21] Appl. No.: 384,771

[22] Filed: Jun. 3, 1982

[51] Int. Cl.[3] ..... A63F 3/00

[52] U.S. Cl. ..... 273/271; 273/153 S

[58] Field of Search ..... 40/620, 622; 273/153 S, 273/157 R, 271, 281, 265, 264, 272; 434/96, 175, 405

[56] References Cited

U.S. PATENT DOCUMENTS

| | | | |
|---|---|---|---|
| 690,664 | 1/1902 | Proctor | 273/153 S X |
| 1,377,039 | 5/1921 | Wells | 273/153 S |
| 2,534,550 | 12/1950 | Frechtmann | 434/96 |
| 3,767,202 | 10/1973 | Sternad | 273/153 S X |
| 4,208,052 | 6/1980 | Snow | 273/153 S X |
| 4,303,246 | 12/1981 | Strongin | 273/271 |

*Primary Examiner*—Harland S. Skogquist
*Attorney, Agent, or Firm*—Benjamin J. Barish

[57] ABSTRACT

A game comprises a base member divided into a plurality of horizontally-extending vertically-aligned zones representing levels of a building structure open at their opposite ends, a plurality of playing pieces in the form of colored blocks adapted to be received in the levels, and a pair of conveyors or elevators at the opposite ends of the zones, each adapted to receive several of the colored blocks for shifting them from one level to another. The total number of colored blocks is less than the number adapted to be accommodated by all the levels, so that there are always some empty spaces in the levels for receiving colored blocks as they are shifted by the use of the conveyors, the object being to fill each level only with the blocks of a single color. Another embodiment is described wherein the playing pieces, instead of being colored blocks, are blocks bearing alphabetical characters, in which case the object is to shift the playing pieces among the levels so as to form words.

9 Claims, 2 Drawing Figures

GAME WITH CONVEYOR

BACKGROUND OF THE INVENTION

The present invention relates to games, and particularly to a type of game which may be played by two players, with each player, in his turn, moving playing pieces about a base member or game board in such manner as to achieve a certain result before that result is achieved by his opponent.

One object of the present invention is to provide a game of the foregoing type requiring each player to exercise a certain degree of skill and foresight in developing both offensive and defensive strategies, i.e., in planning his moves according to certain strategies in order to achieve a sought-after result, while at the same time trying to anticipate the strategy of his opponent in order to block him from achieving his sought-after result. Another object of the present invention is to provide a game of this type which can be played according to a few very simple rules requiring but a short time to learn. A further object is to provide a game of this type which, by varying the rules, can be adapted to varying levels of difficulty.

SUMMARY OF THE INVENTION

According to the present invention, there is provided a game comprising a base member divided into a plurality of aligned zones each open at least at one end, and a plurality of playing pieces of like dimensions, at least some of which are visually distinguishable from others, adapted to be received in the zones. The game further includes a slidable conveyor slidable over the base member for shifting playing pieces from one zone to another. The total number of playing pieces included in the game is less than the total number adapted to be accommodated in all the zones, so that there are always some empty spaces in the zones for receiving the playing pieces shifted by the use of the conveyor.

In the preferred embodiment of the invention described below, there are two conveyors each having a length to accommodate at least two of the playing pieces. In addition, each of the zones extends in the horizontal direction, and all are aligned in the vertical direction, so as to represent or simulate different levels or stories of a building. The two conveyors represent lifts, and are movable up and down along the opposite sides of the vertically-aligned levels.

As one example, the game could include: (a) nine vertically-aligned zones or levels, each adapted to accommodate five playing pieces; (b) 40 playing pieces in the form of colored blocks, divided into eight groups of five blocks in each group, with the blocks of each group of a distinguishable color from those of the other groups; and (c) two vertically-movable conveyors or lifts each adapted to accommodate three blocks. The object of this embodiment of the invention is for each player, in his turn, to use his conveyor in order to shift the blocks from one level to another until each level has a group of five blocks of the same color.

Another embodiment of the invention is described wherein the playing pieces bear alphabetical characters, the object of this embodiment being to shift the playing pieces among the levels so as to form words.

Further features of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
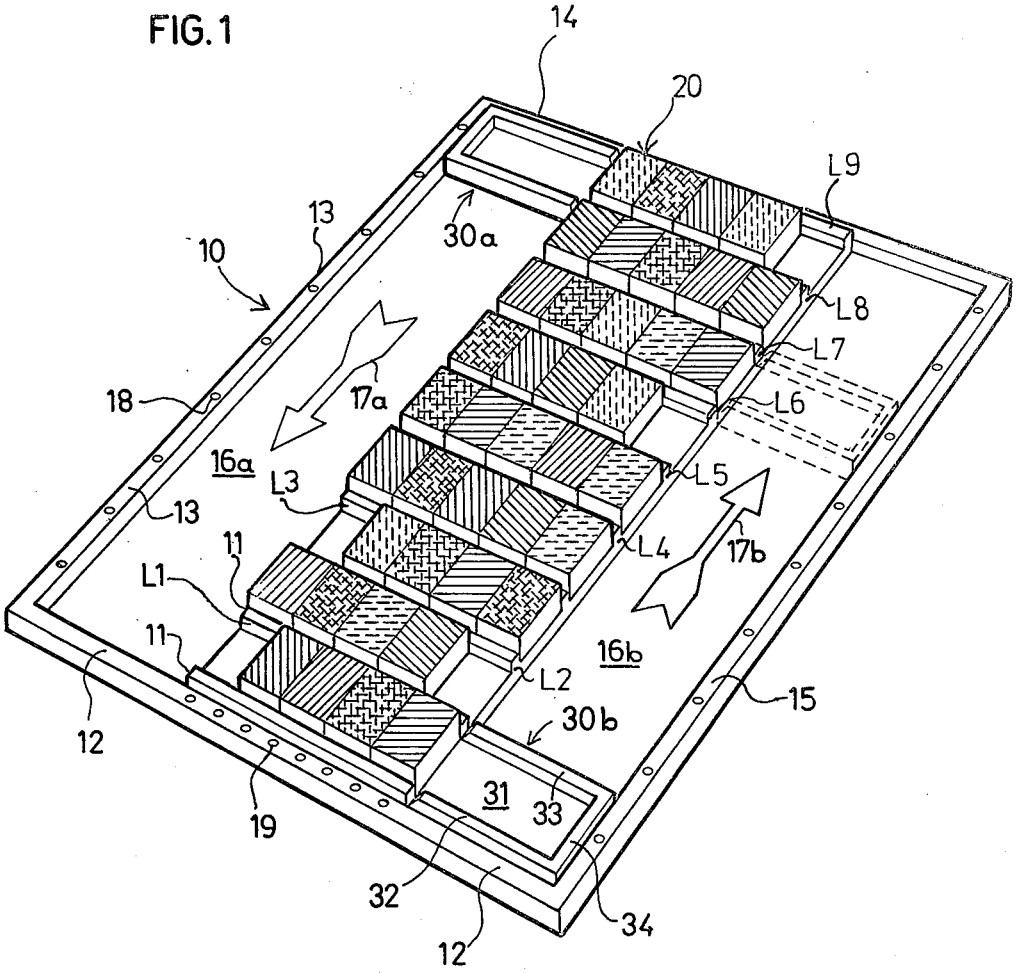
FIG. 1 is a three-dimensional view illustrating one preferred embodiment of the invention.

The embodiment of the invention illustrated in FIG. 1 comprises three main components, namely: (a) a base member, generally designated 10, divided into a plurality of aligned zones; (b) a plurality of playing pieces or blocks, generally designated 20, shiftable among the zones of the base member; and (c) a pair of slidable conveyors, designated 30*a* and 30*b*, one for each player, which conveyors are used for shifting the blocks among the zones of the base member.

More particularly, the base member 10 serves as a game board. It is made of a suitable, e.g., plastics, material with a bottom flat face for stably resting on a table or other horizontal support. On its upper face it is formed with a number of ledges 11 defining a plurality of horizontally-extending, vertically-aligned zones or levels in the central area of the base member. In the described embodiment, the ledges 11 define nine such levels $L_1$–$L_9$, representing nine different levels or stories of a building. Each of these levels has a height (in the vertical direction) equal to the height of each of the playing pieces 20, and a length (in the horizontal direction) equal to a multiple, in this case five, of the corresponding dimensions of the playing pieces 20, so that each level can thereby accommodate five such playing pieces.

The game board 10 is of rectangular configuration and is formed with further ledges 12, 13, 14 and 15, about its periphery. The upper face of the game board on each side of the level-defining ledges 11 and the two end peripheral ledges 13 and 15, respectively, are flat and are dimensioned such as to form tracks, designated 16*a* and 16*b* respectively, for the two slidable conveyors 30*a* and 30*b*.

In the described embodiment, the slidable conveyors 30*a*, 30*b* represents lifts or elevators each movable along the respective side of the levels $L_1$–$L_9$ for shifting the playing pieces among the different levels. Thus, when playing the game, each player faces the other on opposite sides of the game board 10, so that one player manipulates elevator 30*a*, and the other player manipulates elevator 30*b*. FIG. 1 illustrates the starting positions of the two elevators in full lines, and also includes an arrow, 17*a*, 17*b* respectively, indicating the direction of movement of each elevator from its starting position.

The circumferential ledges 12–15 of the game board 10 are formed with recesses 18 and 19 for receiving scoring pins (not shown) which may be used in keeping track of the score during the playing of the game, as will be described below.

The playing pieces 20 are of differently-colored blocks and are so dimensioned so that five such blocks can be accommodated in each of the nine levels $L_1$–$L_9$ of the game board 10. However, the total number of colored blocks to be used in the game is less than the total number adapted to be accommodated by all the levels, so that there will always be some empty spaces in the levels for receiving the colored blocks as they are shifted by the use of the elevators 30*a*, 30*b*.

Thus, in the described example there are nine levels $L_1$–$L_9$, each dimensioned so as to accommodate five colored blocks 20; the total capacity of all nine levels is therefore 45 colored blocks. In the illustrated game, there are but 40 colored blocks, consisting of eight groups of five blocks in each group, with the blocks of each group of a distinguishing color from those of the other groups. Thus, there will always be five of the 45 spaces which are not occupied by the colored blocks, these five empty spaces permitting the shifting of blocks from one level to another, as will be described more particularly below.

The two conveyors or elevators 30*a*, 30*b*, one for each of the players, are of the same construction; thus, each includes a flat hollow wall 31 circumscribed by three peripheral walls 32, 33 and 34, the elevator being open at the end facing the ledges defining the levels 21. Each elevator 30*a*, 30*b* may be moved along its respective track 16*a*, 16*b* so as to communicate, via its open end, with the open ends of all the levels $L_1$–$L_9$ along its respective side.

The interior area of each elevator 30*a*, 30*b* is dimensioned so as to accommodate a plurality of the colored blocks 20, but less than the number accommodated by each of the levels $L_1$–$L_9$. Thus, in the described example wherein each level accommodates five such playing blocks, each elevator 30*a*, 30*b* in the described example accommodates three colored blocks.

Following is one set of rules according to which the game illustrated in FIG. 1 may be played:

First, the 40 colored blocks 20 are randomly distributed among the nine zones or levels $L_1$–$L_9$, one-by-one and alternately, by the two players with the proviso that no two identically-colored blocks may be placed adjacent to each other in any level. Even with this proviso, the number of permutations and combinations for this initial game configuration is almost limitless.

The starting player may then be chosen by lot. The chosen starting player selects his side of the game board 10 and makes the first move, after which the players alternate in moves.

During each move, a player completely fills his elevator 30*a* or 30*b* from his side of the game board with three of the colored blocks 20 from any one, two or three of the levels $L_1$–$L_9$; and by moving his elevator, he empties them in any one, two or three levels, according to his own option. The provisos here are: (a) that blocks can be shifted only by sliding them so as to load or unload the elevator; (b) that the elevator must be completely loaded in each turn; (c) that the elevator must be completely unloaded in each turn; and (d) that whenever three, four or five blocks 20 of the same color are adjacent to each other, they may not be split but must be moved together, if at all, as a unit. (A possible modification of the latter proviso is that whenever there are two or more blocks of the same color adjacent to each other, such blocks cannot be split, but must be moved as a unit.)

When any player succeeds in completing a level with five blocks of all the same color, he scores a "win", which may be recorded by inserting a pin within one of the recesses 18.

The game, however, continues in the same manner as described above until all levels have been filled with blocks of the same color, or until further progress is impossible, in which case each of the unfilled levels is considered to be a "tie".

The recesses 18 along the two vertical edges of the game board 10 may be used for scoring the winning points with respect to the levels in any one game, and the recesses 19 along the horizontal edges of the game board may be used for scoring points with respect to the complete game.

Figure 2:
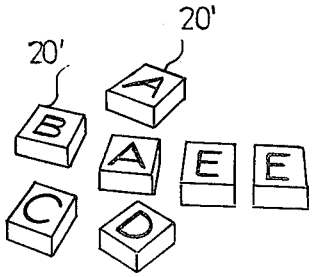
FIG. 2 illustrates a modification of the game of FIG. 1, namely wherein the playing pieces bear different alphabetical characters for forming words, which modification constitutes a second preferred embodiment of the invention.

FIG. 2 illustrates a variation, wherein the playing pieces, therein designated 20', bear alphabetical letters, rather than different colors. In this embodiment, the object of the game would be to shift the character-bearing playing pieces 20' such as to form words in each level $L_1$–$L_9$. In order to permit a maximum number of possible word combinations with a limited number of blocks, the blocks should include more of the frequently-appearing characters, such as the vowels, and fewer of the less frequently-appearing characters, such as many of the consonants.

It will be appreciated that other variations and applications of the invention may be made. For example, the embodiment of the invention illustrated in FIG. 1 may be played in a solitaire manner, using either both elevators 30*a*, 30*b*, or using only one elevator. In the latter case, the levels may be closed at one end and open only at the end visited by the one elevator, but more empty levels would then be provided to permit the shifting only through one end. In addition, the zones need not be in the form of vertically-aligned levels $L_1$–$L_9$, but could be in the form of horizontally-aligned zones, whereupon the conveyors 30*a*, 30*b* would not be vertically movable elevators, but rather would be horizontally movable conveyors. Further, the illustrated embodiment may be made more difficult by increasing the number of playing pieces which can be accommodated in each of the zones, e.g., from 5 to 7, 9, 11, 13, etc., an "odd" number being preferred; whereupon the capacity of each of the conveyors 30*a*, 30*b* would also be increased. Alternatively, the game could be made simpler by decreasing the number of playing pieces which could be accommodated in each zone and in each conveyor, but the number of playing pieces to be accommodated in each conveyor should be at least two. Still further, the number of levels can be either increased or decreased, as desired. In addition, instead of using differently-colored blocks, or character-bearing blocks for the playing pieces 20 (or 20'), the playing pieces could have other markings for visually distinguishing them from each other. Many other variations, modifications and applications of the invention will be apparent.

What is claimed is:

1. A game, comprising:

a base member divided into a plurality of aligned zones each open at their opposite ends;

a plurality of playing pieces of like dimensions adapted to be received in said zones, at least some of said playing pieces being individually distinguishable from others;

and a conveyor at each of said opposite ends of the zones, each conveyor having a length to receive at least two playing pieces but less than the number adapted to be received in each of said zones, said conveyor being slidable along the open ends of the aligned zones for shifting playing pieces from one zone to another;

the total number of playing pieces included in the game being less than the total number adapted to be accommodated in all said zones, such that there are always some empty spaces in the zones for receiving playing pieces as they are shifted among the zones by the use of said slidable conveyor.

2. The game according to claim 1, wherein the playing pieces include different alphabetical letters for forming different words within the zones.

3. The game according to claim 2, wherein each of said aligned zones extends along one orthogonal coordinate and has a length equal to a multiple of the length of each playing piece, said plurality of zones being aligned with each other along the other orthogonal coordinate, with their opposite open ends, along which said conveyors are slidable, also being aligned along said other orthogonal coordinate.

4. The game according to claim 3, wherein each of said zones extends along the horizontal coordinate and all said zones are aligned along the vertical coordinate to represent different levels of a building, said conveyors representing elevators and being slidable vertically along the opposite open ends of the different levels to shift the playing pieces from one level to another.

5. The game according to claim 4, wherein the playing pieces in each group are differently-colored blocks.

6. The game according to claim 5, wherein there are nine horizontally-extending, vertically-extending zones each adapted to accommodate five colored blocks, there being eight groups of colored blocks with each group including five blocks of the same color, each of said elevators being adapted to accommodate three of said colored blocks.

7. The game according to claim 1, wherein the upper face of said base member is formed with a plurality of spaced parallel ledges for dividing it into said plurality of aligned zones each open at its opposite ends.

8. The game according to claim 7, wherein the upper face of said base member is formed with a flat portion thereof bordering each side of said parallel ledges to define tracks along which said conveyors are slidable.

9. The game according to claim 8, wherein each of said conveyors includes a flat bottom wall circumscribed by three peripheral walls open at the end facing said aligned ledges.

* * * * *